United States Patent [19]

Krygier

[11] 4,067,310

[45] Jan. 10, 1978

[54] WHEEL TRIMMER

[75] Inventor: Edward Z. Krygier, Royal Oak, Mich.

[73] Assignee: Lear Siegler, Inc., Santa Monica, Calif.

[21] Appl. No.: 714,830

[22] Filed: Aug. 16, 1976

[51] Int. Cl.[2] ..... B24B 53/08

[52] U.S. Cl. ..... 125/11 TP

[58] Field of Search ..... 125/11 R, 11 TP, 11 PH, 125/11 CC, 11 T

[56] References Cited

U.S. PATENT DOCUMENTS

| | | | |
|---|---|---|---|
| 2,073,577 | 3/1937 | Cole | 125/11 TP |
| 2,134,607 | 10/1938 | Harley | 125/11 TP |
| 2,415,010 | 1/1947 | Hill | 125/11 TP |
| 3,170,453 | 2/1965 | Pernack | 125/11 TP |

FOREIGN PATENT DOCUMENTS

| | | | |
|---|---|---|---|
| 882,999 | 11/1961 | United Kingdom | 125/11 TP |

*Primary Examiner*—Harold D. Whitehead
*Attorney, Agent, or Firm*—Whittemore, Hulbert & Belknap

[57] ABSTRACT

A trimmer for a grinding wheel comprising two templates operable sequentially to effect movement of a diamond trimming point to produce a cross-sectional curve on the grinding wheel in the form of a modified involute or the like.

12 Claims, 4 Drawing Figures

FIG. 1
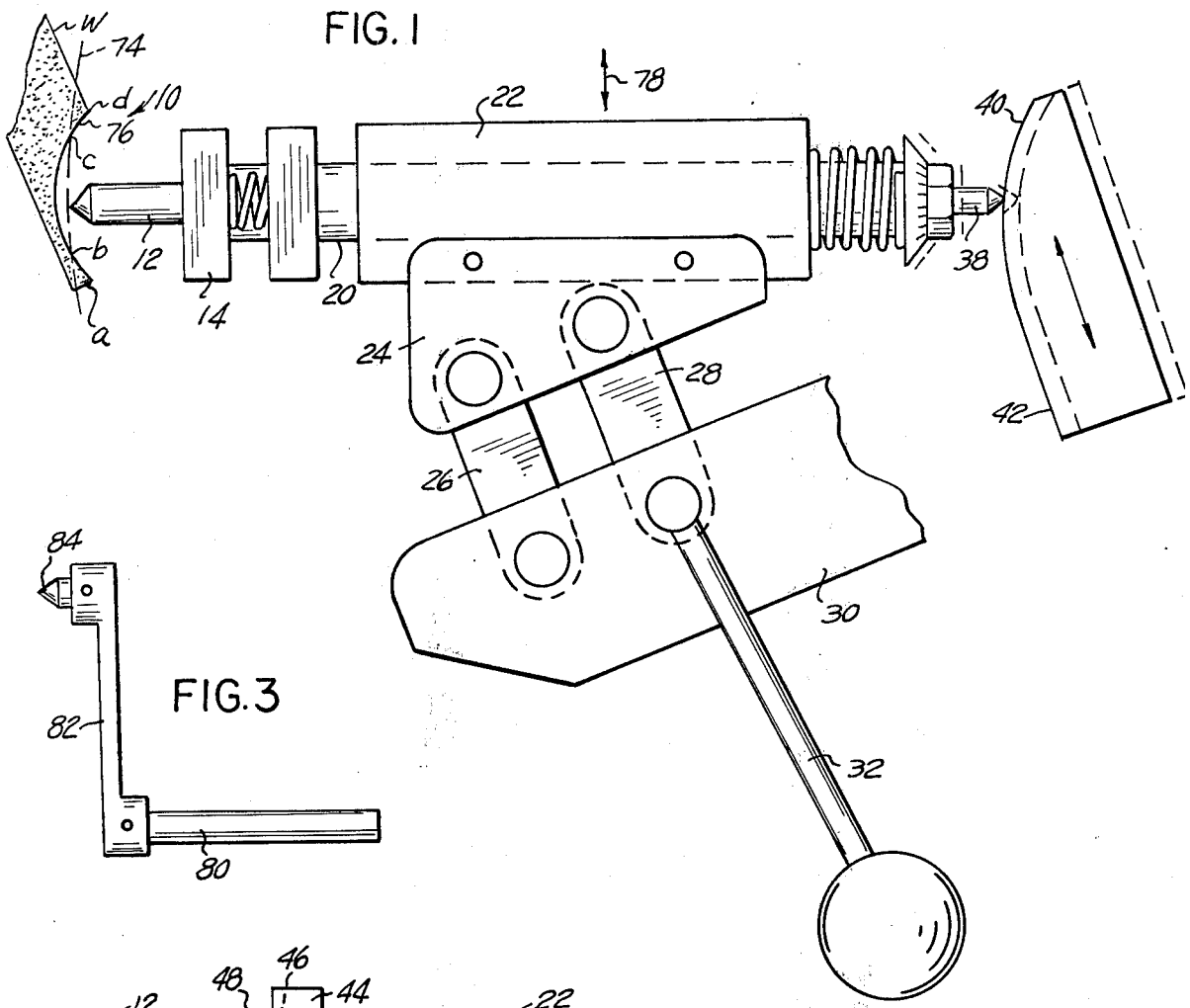
FIG. 3
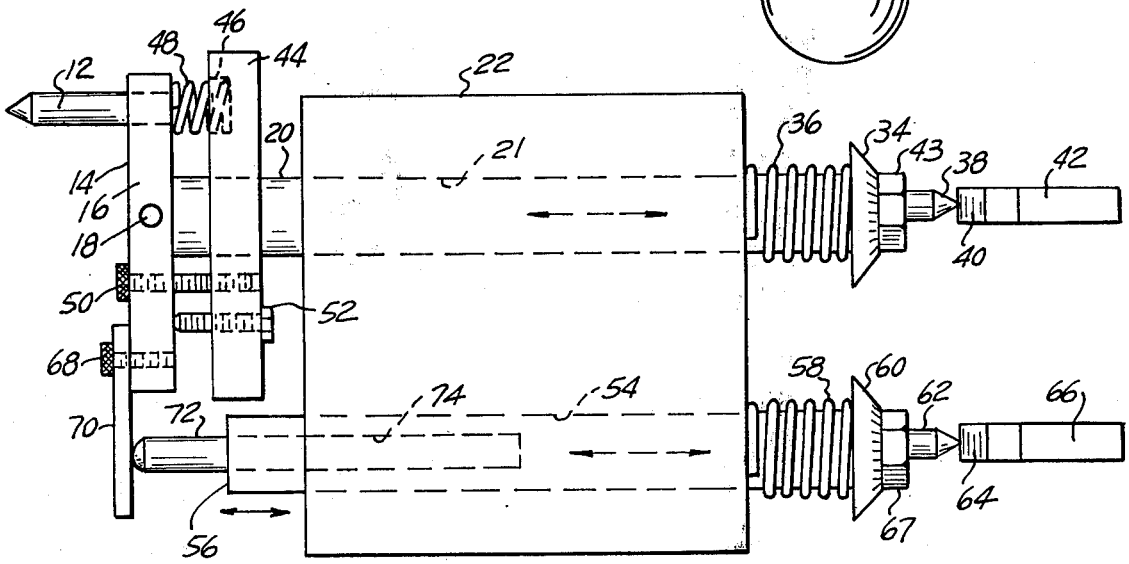
FIG. 2

WHEEL TRIMMER

BRIEF SUMMARY OF THE INVENTION

In prior U.S. Pat. No. 3,170,453 there is disclosed a trimmer for a grinding wheel in which a diamond trimming point is moved by mechanism including a template having the identical curvature intended to be trimmed as the cross-sectional shape of the wheel. Generally speaking, it is desirable to provide the template in the form of a generated curve such for example as an involute, where the tool is used for grinding the teeth of an involute gear. In many cases however, it is desirable to provide a slight modification to the involute curvature of the template intermediate the ends thereof. While conceivably this may be done by providing a like modification to the involute curvature of the template, this is objectionable for several reasons. In the first place it complicates the grinding of the template. In the second place, where the template is properly ground with the modification, errors are introduced as the diameter of the grinding wheel is reduced by repeated trimming. It is essential where such modification is to be imparted to the tooth of a gear by a grinding operation, that the radial inner and outer ends of the modification remain at the precise desired location.

In accordance with the present invention, two templates are provided, one of which is ground to the general involute form desired on the tooth, and the other of which is provided with a special curvature. The diamond trimming point is mounted on a movable carrier and throughout a portion of the traverse of the follower across the basic template, the diamond trimmer moves in an identical involute path. However, throughout an intermediate zone of traverse, the second template is engaged by a follower which imparts a corrective movement to the carrier so as to produce the required modification.

In the ordinary case the mechanism is arranged so that a slight withdrawal movement is superimposed on the diamond trimming point, thus producing on the wheel a curvature which is an involute with an intermediate protruberance. It will of course be understood that such modified involute on the wheel produces on the gear tooth an involute with a corresponding intermediate hollow.

BRIEF DESCRIPTION OF THE DRAWINGS

FIG. 1 is a more or less diagrammatic elevational view of the trimming mechanism.

FIG. 2 is a plan view of the structure shown in FIG. 1.

FIG. 3 is a detailed view of an element which may be substituted into the combination illustrated in FIG. 2.

DETAILED DESCRIPTION

Figure 4:
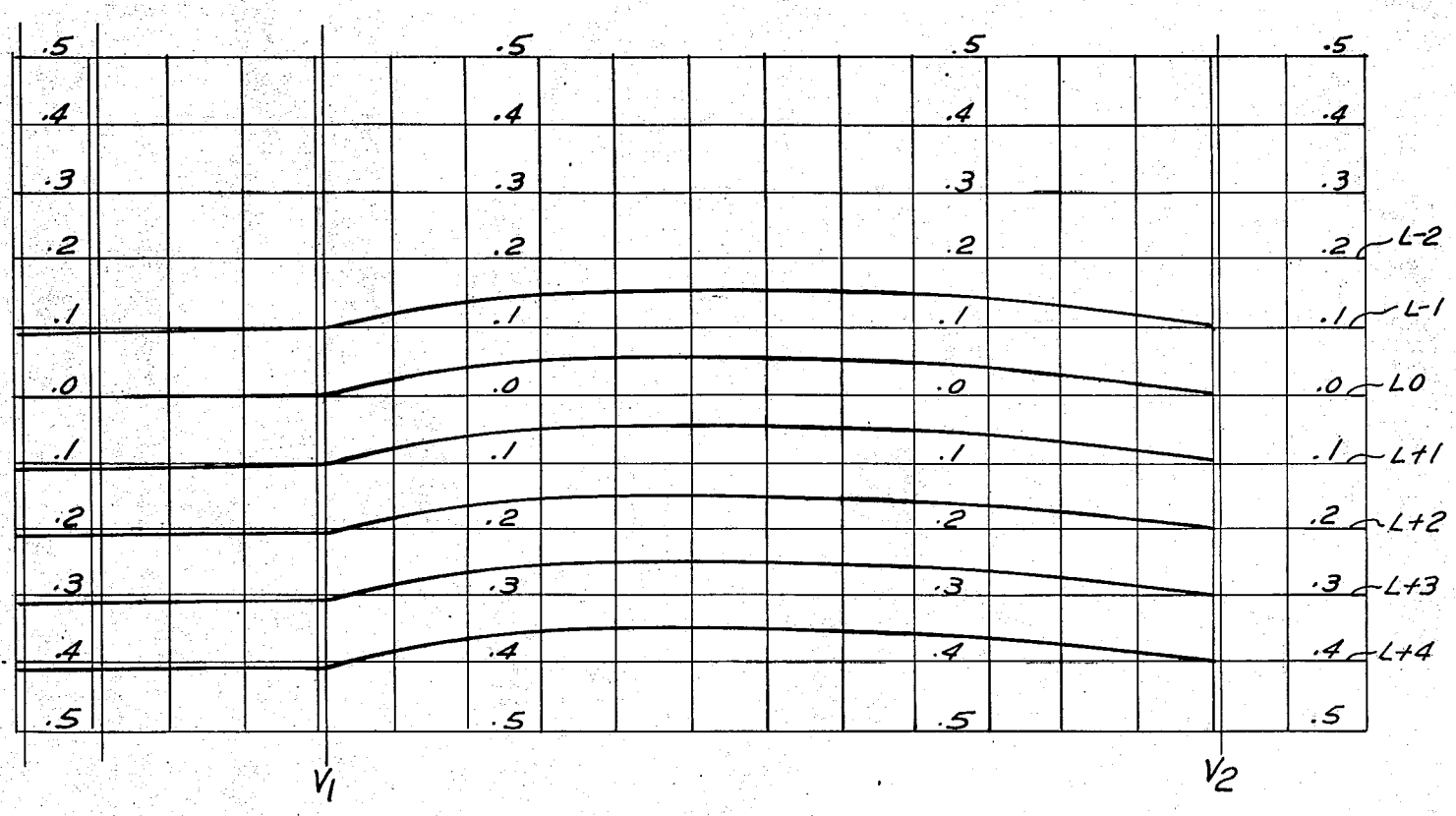
FIG. 4 is a reproduction of a chart showing the modified involute curvature produced by the present invention.

In the drawings a portion of a grinding wheel is illustrated at W having an edge portion indicated generally at 10 which is trimmed to a curvature to be reproduced on the sides of gear teeth during a conventional grinding operation.

In the usual case the trimming operation is carried out while the grinding wheel is rotated about its axis, usually horizontal, and the trimming mechanism is actuated to cause the diamond trimming point 12 to repeatedly traverse the edge of the wheel as it is rotated. The trimming mechanism is mounted for advancement toward the wheel to determine the amount of material removed in a trimming operation, and the trimming is continued until the traversing of the trimming point 12 ceases to remove significant amounts of material from the wheel, at which time the wheel is trimmed to the required curvature.

The diamond trimming point 12 in the present case is mounted on a movable carrier 14 which is herein illustrated as a lever 16 pivoted as indicated at 18 to a rod or slide 20 which is longitudinally slidable in an opening 21 provided in the holder 22. The holder 22 is carried by a bracket 24 which is connected by parallel links 26 and 28 to an adjustable support 30. One of the links, as for example the link 28 as seen in FIG. 1, is rigidly connected to a rigid actuating arm 32.

The rod 20 carries an abutment 34 engaged by a compression spring 36 which moves the rod 20 to the right as seen in FIG. 2 so that a follower 38 engages the trimmed profile 40 of a template 42. Suitable threaded means including a nut 43 is provided to effect adjustment of the follower 38 longitudinally of the rod 20.

Rigidly connected to the rod 20 is a support 44 having a recess 46 therein receiving a compression spring 48 one end of which engages the lever 16.

In FIG. 2 there is illustrated a screw 50 which in the position illustrated immobilizes the lever 16 with respect to the rod 20. However, when carrying out the trimming operation in which a modified form is applied to the wheel curvature, the screw 50 is removed so that the lever 16 is movable about its pivot support 18. Such movement is normally prevented during a trimming operation by the spring 48 which urges the lever 16 in a counterclockwise direction against an abutment screw 52.

The holder 22 is provided with a second opening 54 in which is slidably received a second rod 56 having a compression spring 58 engaging an abutment 60 and adapted to hold a follower 62 into engagement with the profile surface 64 of a second template 66. Again, threaded means including the nut 67 are provided for effecting adjustment of the follower 62 relative to the rod 56. Connected to the lever 16 by a screw indicated at 68 is an extension 70 which is engageable by a pin 72 received in an opening 74 provided in the rod 56.

When the shape and location of the template 66 is such as to impart sliding movement to the rod 56 and pin 72 to the left as seen in FIG. 2, relative to slide 20, as a result of engagement by the follower 62 with the template surface 64, the lever 16 is rocked in a clockwise direction so that the diamond trimmer 12 is moved away from the edge of the grinding wheel, thus causing the diamond trimmer 12 to follow a curvature different from the template surface 40.

Referring to FIG. 1 the diamond trimmer 12 is illustrated as in position adjacent the mid-portion of the edge curve of the grinding wheel W and it will be observed that at this point it is moving in a path indicated by the dotted line 74 and has been withdrawn from the full line curvature illustrated in full lines at 76. Accordingly, the profile trimmed onto the grinding wheel W by movement of the holder 22 will be from the point *a* to the point *b* along the full line curvature 76 as determined by the template surface 40, then from the point *b* to the point *c* along the dotted line curvature 74 as determined by the template 66, and finally from the point *c* to the point *d* along the full line curvature 76, and vice-versa.

It will of course be appreciated that the template 66 may be adjusted to the right and left as seen in the Figures so that the extent of the trimmed surface controlled by the template 66 may be varied.

Another significant advantage of the present invention is that the degree of curvature of the dotted line 74 may be varied as will now be explained. Conveniently, the curved surface 64 on the template 66 is also an involute surface which, as is well understood, has a radius of curvature which increases along the involute from its origin adjacent its base circle. Accordingly, by appropriate adjustment of the template 66 to select a portion of the involute surface 64 having the desired average radius of curvature, the effective radius of curvature of dotted line 74 may be adjusted.

It will be appreciated that the parallel links 26 and 28 cause the holder 22 to move in an arcuate path but since the rods 20 and 56 are freely longitudinally slidable therein, only the vertical component of motion as indicated by the arrow 78 is effective to cause the trimming point 12 to move across the edge of the grinding wheel.

It will further be understood that the illustration of FIG. 1 is more or less diagrammatic and that the location and lengths of the links 26 and 28 will be selected such that diamond trimmer 12 will move completely across the edge of the wheel. In the illustrated position of the diamond trimmer the parallel links 26 and 28 would normally be at about 45° from the axis of the rod 20, rather than as illustrated.

In FIG. 3 there is illustrated an attachment by means of which the present trimmer may be modified to perform a trimming operation in which closely adjacent diamond trimming points operate simultaneously in the manner fully illustrated in prior U.S. Pat. No. 3,170,453, assigned to assignee herein. For this operation the screw 50 is applied as illustrated in FIG. 2 so that the lever 16 becomes fixed with reference to the rod 20. At the same time the screw 68 is operated to remove the extension 70 so that the template 66 and associated mechanism becomes ineffective to move lever 16. At this time the pin 72 is removed from the rod 56 and the pin 80 is inserted in the rod 56. The pin 80 has rigidly secured thereto a lateral arm 82 carrying a second diamond trimming point 84 which at this time will be positioned closely adjacent the diamond trimmer 12. Operation of lever 32 will cause both diamond trimming points to move in paths determined by templates 42 and 66, and the material will be removed from the wheel successively at different zones, by the two trimming points.

Attention is called to the fact that in the illustrated embodiment of the invention the distance between the pivot 18 and the axis of the rod 56 is approximately twice as great as the distance between the pivot and the diamond trimming point 12. Accordingly, in providing the required curvature 64 on the template 66 this different displacement must be taken into account as well as the actual distance between the axis of pivot 18 and the true end or trimming point of the trimmer 12. It will be appreciated that instead of using the template 66 and associated mechanism to produce a curvature correction midway between the ends of the surface being trimmed, the modification could be provided to the ends, leaving the mid-portion of the curve as determined by template 42.

In FIG. 4 there is illustrated a chart produced by an involute checker of conventional form. Horizontal lines Lo, L−1, L+1, L−2, etc. are illustrated. An involute which is checked to originate along line Lo is seen to have a departure from this line of approximately half the spacing between lines Lo and L−1. The lines are numbered 0.0, 0.1, 0.2, etc., and on the actual chart paper the space between adjacent numbered lines is divided into five equal parts. The departure of the involute from one line to another is 0.0001 inch.

The line Lo represents a zero line so that if the measured curve coincides with a line throughout it is a true line from top to bottom. This represents a departure from the true involute of 0.0005 inch, indicating a negative involute. The vertical lines on the chart represent the degree of roll which causes the involute follower to move from the base circle or start of active profile to the crest of the tooth.

In the actual chart corresponding sides of six different teeth were checked and adjustments were made to start the check along the lines L−1, Lo, L+1, L+2, L+3, and 1+4. It will be observed that all modifications start at the same vertical line V1 and terminate at the same vertical line V2, thus indicating that the modification was imparted to precisely the same portion of the teeth of the gear.

It will be observed that the amount of modification and the location of the modification on all six teeth is substantially identical.

It may be mentioned at this time that while the trimmer may be used to trim a grinding wheel which in turn is used to grind gear teeth, the usual purpose of the trimmer is to trim a grinding wheel used in grinding gear-like finishing tools to the precise required dimensions. Specifically, the present invention is applicable to grind gear tooth shaving tools or gear tooth rolling tools.

From the foregoing it will be observed that the template form 4 is spaced from and parallel to the path 76 followed by trimming point 12 through a portion of its movement. Trimming point 12 is on a carrier 14 pivoted to the slide 20, and normally retained against abutment 52 by spring 48. The slide 20 is slidable longitudinally in a holder movable across the space between the template and wheel, and as a result, slide 20 is movable longitudinally between said template and wheel. Without more, the trimming point 12 would trim the periphery of the wheel W to a cross-section identical with template 40.

However, the modification control mechanism 66, 62, 56, 72, 70 rocks carrier 14 as required to produce the wheel modification shown in exaggerated form at *bc* in FIG. 1. This mechanism is operated in timed relation to the trimming mechanism 40, 38, 20, 14, 12, since it is operated by movement of holder 22 across the space between template 42 and wheel periphery 10.

What I claim as my invention is:

1. A trimmer for a grinding wheel having a template provided with a form which is the reverse of the general form to be trimmed into the periphery of a grinding wheel at a 1:1 ratio spaced from and generally parallel to the portion of the wheel to be trimmed, a holder movable across the space between the template form and the portion of the wheel to be trimmed, an elongated slide movable longitudinally between said template form and said wheel portion, a template follower at one end of said slide, a carrier movably mounted on the slide, a trimming point mounted on the carrier, an abutment on said slide, resilient means normally urging said carrier against said abutment to oppose movement of said carrier relative to said slide, means for traversing said holder across the space between said template and wheel to produce a corresponding path of movement of said trimming point while said carrier engages said abutment, and modification control mechanism operable in timed relation to movement of said follower across said template to move said carrier away from said abutment and relative to said slide to produce a modification of a portion of the path of movement of said trimming point from the shape of said template.

2. A trimmer as defined in claim 1 in which said modification control mechanism comprises a second template and second follower, and means operatively connecting said second follower to said carrier.

3. A trimmer as defined in claim 2 in which said carrier is a lever pivotally mounted on said slide.

4. A trimmer as defined in claim 3 in which the templates are in side-by-side relation, and the means connecting said second follower to said carrier comprises a second slide parallel with said first slide and engageable with said carrier to pivot said carrier against said resilient means relative to said first slide.

5. A trimmer as defined in claim 4 comprising independently adjustable means for adjusting said followers longitudinally of said slides.

6. A trimmer as defined in claim 1 in which said holder is connected by a parallel motion device to a fixed support.

7. A trimmer as defined in claim 6 in which said modification control mechanism comprises a second template and second follower, and means operatively connecting said second follower to said carrier.

8. A trimmer as defined in claim 6 in which said carrier is a lever pivotally mounted on said slide.

9. A trimmer as defined in claim 8 in which the templates are in side-by-side relation and the means connecting said second follower to said carrier comprises a second slide parallel with said first slide and engageable with said carrier to pivot said carrier against said resilient means relative to said first slide.

10. A trimmer as defined in claim 9 comprising means for fixing said first slide to said carrier, means for mounting a second trimming point on said second slide for movement relative thereto, said mounting means comprising a lateral extension mounting said second trimming point closely adjacent to said first trimming point for movement relative thereto, whereby said trimming points operate in sequence on a grinding wheel.

11. A wheel trimmer for trimming onto a grinding wheel for grinding gear teeth to a profile which is generally involute but is provided with a predetermined modification which extends over the gear teeth throughout an intermediate zone which is spaced from the roots and crests of the gear teeth, and in which the trimmed zone of the wheel is an annular zone adjacent its periphery which in radial section has a curvature identical with that to be ground onto the gear teeth, said trimmer comprising a first template having an involute profile thereon which has the identical curvature of the involute profile desired but without the desired modification thereof, means for supporting said template in spaced relation to the trimmed wheel zone and with the template profile parallel to the unmodified profile to be ground on the wheel, a holder movable transversely through the space between the template and the trimmed wheel zone, a slide carried by said holder and movable relatively thereto toward and away from said template and trimmed zone, a template follower on said slide, a carrier movably supported on said slide, an abutment on said slide, resilient means urging said carrier against said abutment, a trimming point on said carrier engageable with the trimmed zone of said wheel and operable while said carrier remains in contact with said abutment to trim the trimmed zone of said wheel to an involute cross-section identical with the involute form on said template, a second template adjacent said first template, a second slide carried by said holder movable in parallelism with said first slide, a second template follower on said second slide, said second slide having means engageable with said carrier and operable to move said carrier away from said abutment in accordance with the shape of said second template during an intermediate portion of the transverse movement of said holder across the space between said first template and trimmed wheel zone to produce a predetermined departure from the involute cross-section of the trimmed zone from the involute cross-section which would otherwise be trimmed on the wheel.

12. A trimmer as defined in claim 11, in which said carrier is pivotally carried by said slide.

* * * * *